United States Patent [19]

Kinast et al.

[11] 4,183,396

[45] Jan. 15, 1980

[54] SEAL FOR A REGENERATIVE HEAT-EXCHANGER

[75] Inventors: Karlheinz Kinast, Plochingen; Klaus Wiegard, Esslingen, both of Fed. Rep. of Germany

[73] Assignee: Daimler-Benz Aktiengesellschaft, Fed. Rep. of Germany

[21] Appl. No.: 848,261

[22] Filed: Nov. 3, 1977

[30] Foreign Application Priority Data

Nov. 12, 1976 [DE] Fed. Rep. of Germany ..... 2651623

[51] Int. Cl.[2] ..... F28D 19/00

[52] U.S. Cl. ..... 165/9; 277/81 R

[58] Field of Search ..... 165/9; 277/81 R, 81 S, 277/83

[56] References Cited

U.S. PATENT DOCUMENTS

| | | | |
|---|---|---|---|
| 3,692,097 | 9/1972 | Penny | 165/9 |
| 3,761,101 | 9/1973 | Good et al. | 165/9 X |

FOREIGN PATENT DOCUMENTS

| | | | |
|---|---|---|---|
| 2451247 | 5/1976 | Fed. Rep. of Germany | 165/9 |
| 2460437 | 6/1976 | Fed. Rep. of Germany | 165/9 |

*Primary Examiner*—Albert W. Davis, Jr.
*Attorney, Agent, or Firm*—Craig and Antonelli

[57] ABSTRACT

A seal for the gas channels of a regenerative heat-exchanger which consists of a sealing bar that abuts at a rotatable disk-shaped storage body and of a sealing diaphragm which, assisted by leaf spring elements, extends over the gap between the sealing bar and the oppositely disposed housing wall; the sealing diaphragm which is V-shaped or U-shaped in cross section, is enclosed along one of its legs and pressed against the sealing bar by a clamping strip secured at its one edge along the sealing bar; with its back side, the sealing diaphragm is disposed opposite at least one abutment arranged at the sealing bar.

10 Claims, 8 Drawing Figures

SEAL FOR A REGENERATIVE HEAT-EXCHANGER

The present invention relates to a seal for the gas channels of a regenerative heat-exchanger, which consists of a sealing bar that abuts at a rotatable disk-shaped storage body, and of a sealing diaphragm V-shaped or U-shaped in cross section which, assisted by leaf spring elements, extends over the gap between the sealing bar and the oppositely disposed housing wall.

With a known seal of this type (German Offenlegungsschrift No. 2,451,247), the sealing diaphragm is composed of a large number of mutually overlapping sealing lamellae which are secured at a leg of an angularly bent support sheet-metal member provided with covered-off cuts or notches and which abut at the same, whereas the other leg thereof is rigidly connected with the sealing bar. Notwithstanding the multi-partite nature of the seal, the yieldingness thereof and therewith the good abutment thereof at the structural parts to be sealed is impaired by the fixed connection of the sealing diaphragm with the support sheet-metal member secured, in its turn, at the sealing bar.

The present invention is concerned with the task to eliminate this disadvantage and to provide a seal which with simple means produces a reliable seal under all operating conditions. This is realized according to the present invention in that the sealing diaphragm is enclosed at its one leg and pressed against the sealing bar by a clamping strip secured at its edge along the sealing bar and is disposed with its back side opposite at least one abutment arranged at the sealing bar. The clamping strip, owing to its yieldingness, permits longitudinal changes of the sealing diaphragm as a result of a differing heat-up so that stresses can be reduced and warpings can be avoided also with a great length of the sealing diaphragm. The sealing diaphragm can therefore be built up of fewer individual parts which leads to a considerable simplification of the manufacture. Notwithstanding the excellent movement possibility of the sealing diaphragm, the same is always held in the correct position relative to the sealing bar by the clamping strip in cooperation with abutments. Finally, the clamping strip enables an easy fastening or disengagement of individual parts of the seal.

According to one advantageous construction of the present invention, the sealing diaphragm retained by the clamping strip is composed of partial members, of which at the connecting place of two partial members, the end of the one partial member terminates in two free legs not directly connected with each other, which are so enclosed by the end of the other partial member that the legs thereof overlap for the most part the free legs of the first-mentioned partial member, whence the clamping strip which is undivided at least at this place, encloses respectively two mutually overlapping legs of the two partial members of the sealing diaphragm. By the subdivision of the sealing diaphragm, one obtains in cooperation with the clamping strip a seal structure which is particularly capable of adaptation. The clamping bar thereby presses the partial members also within the area of their overlap tightly against the sealing bar without preventing a movability of the partial members among one another and with respect to the sealing bar, which is desirable for the compensation of thermal expansions.

According to the present invention, a cover member V-shaped or U-shaped in cross section may be arranged within the area of the overlapping ends of the partial members of the sealing diaphragm and inside thereof, whose one leg is also enclosed by the clamping strip. The seal can be further improved within the area of the overlapping partial members by the diaphragm member, whereby the clamping strip dispenses with additional fastening means.

With the use of a sealing bar which consists of a ring-shaped partial member and of a web-like partial member which is inserted with its two ends with play into mutually oppositely disposed recesses in the ring-shaped partial member for the formation of an expansion joint and which separates from one another the gas inlet channel and the air discharge channel, also the sealing diaphragm has to be subdivided correspondingly. The relative movements of the individual partial members of the sealing diaphragm which are possible thereby, make more difficult the seal within the area of their connection. Thus, with the known prior art construction, in which the separating line of the sealing diaphragm is located on the ring-shaped partial member of the sealing bar, it may lead with the stronger thermal expansion of the web-like partial member to a shifting and offset of the partial members of the sealing diaphragm with respect to one another and therewith to an impairment of the seal. This is avoided according to the present invention in that within the area of each connecting place between the ring-shaped partial member and the web-like partial member of the sealing bar, the partial member of the sealing diaphragm which is retained on the web-like partial member by a partial member of the clamping strip, terminates in free legs which are enclosed by the inwardly curved end of the partial member of the sealing diaphragm which is retained on the ring-shaped partial member of the sealing bar by a partial member of the clamping strip. Above all, the particular subdivision of the sealing diaphragm within the area of the web-like partial member of the sealing bar contributes thereby to the good seal achieved therewith, in which the movability of the sealing diaphragm achieved by the clamping strip is utilized in an advantageous manner. The construction of the seal according to the present invention therebeyond facilitates by its simplicity the assembly and disassembly of the web-like partial member of the sealing bar together with the partial member of the sealing diaphragm retained thereon by the clamping strip.

Accordingly, it is an object of the present invention to provide a seal for a regenerative heat-exchanger which avoids by extremely simple means for aforementioned shortcomings and drawbacks encountered in the prior art.

Another object of the present invention resides in a seal for a regenerative heat-exchanger which assures a completely satisfactory seal under all operating conditions by extremely simple means.

A further object of the present invention resides in a sealing arrangement for a regenerative heat-exchanger in which stresses caused by differing heat-ups are effectively reduced and warpings are avoided even with substantial length of the sealing diaphragm.

Still another object of the present invention resides in a seal for a regenerative heat-exchanger in which the sealing diaphragm can be assembled of relatively fewer individual parts, resulting in considerable simplification of manufacture and assembly thereof.

A further object of the present invention resides in a sealing arrangement for a regenerative heat-exchanger in which the individual parts can be readily assembled and disassembled.

These and other objects, features and advantages of the present invention will become more apparent from the following description when taken in connection with the accompanying drawing which shows, for purposes of illustration only, two embodiments in accordance with the present invention, and wherein.

Figure 1:
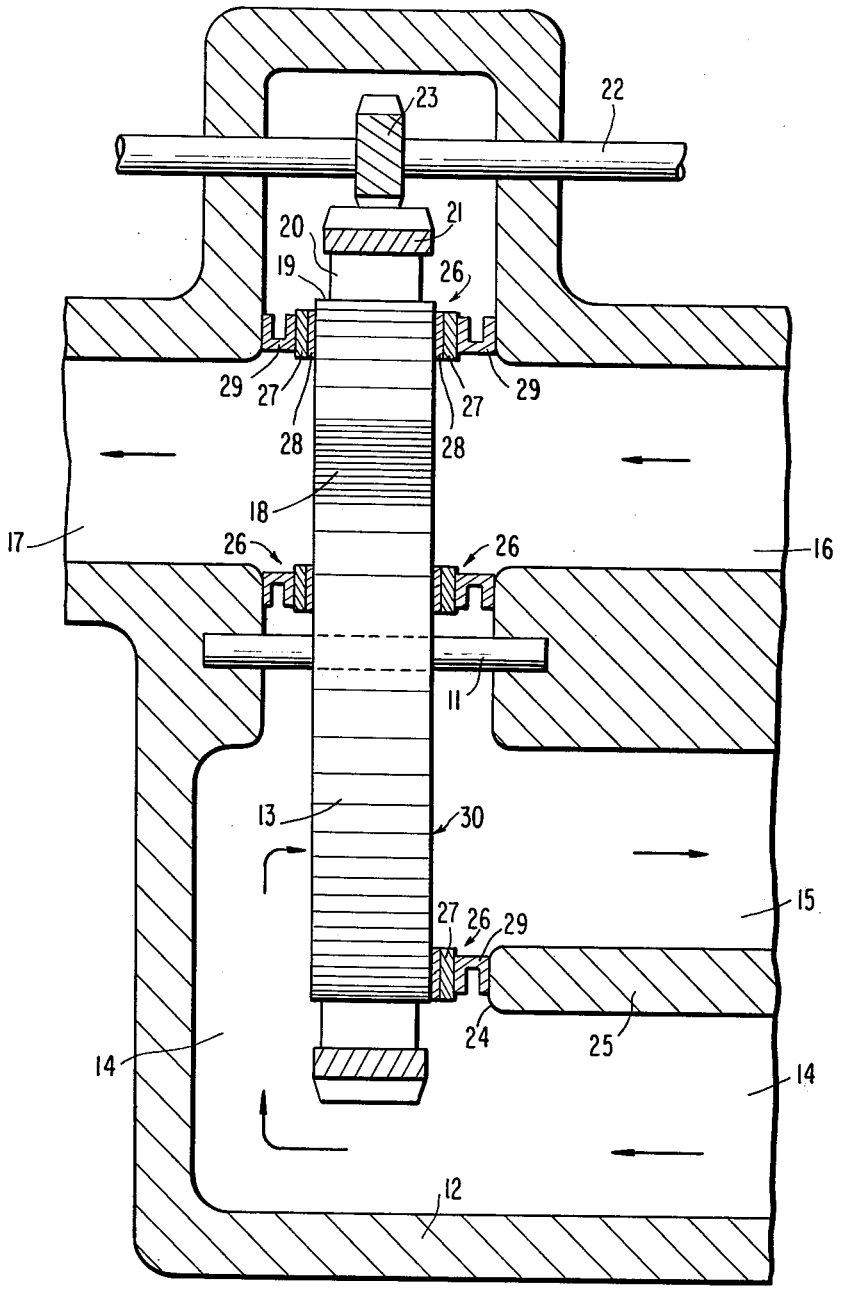
FIG. 1 is a schematic longitudinal cross-sectional view through a regenerative heat-exchanger utilizing a sealing arrangement in accordance with the present invention.

Referring now to the drawing wherein like reference numerals are used throughout the various views to designate like parts, the regenerative heat-exchanger of a motor vehicle gas turbine, illustrated in FIG. 1, essentially consists of a disk-shaped storage body 13 of any known construction rotatably supported on a shaft 11 within a housing 12, of channels 14 and 15 for the combustion air as well as of channels 16 and 17 for the exhaust gases. The storage body 13 which is made of glass ceramic material, is traversed in the axial direction by a large number of small passages or through-channels 18. A coaxial toothed rim 21 is secured on the outer surface 19 of the storage body 13 by means of elastic intermediate members 20. A pinion 23 supported on the shaft 22 within the housing 12 engages in the toothed rim 21. The storage body 13 can be set into rotation by way of the shaft 22, the pinion 23 and the toothed rim 21 by an auxiliary drive (not shown) of the gas turbine.

During the operation of the gas turbine, the hot exhaust gases are conducted through the channel 16 to the driven storage body 13, whereby the hot exhaust gases flow through the through-channels 18 and thereby give off a part of their heat to the storage body 13. The heated-up sections of the storage body 13 are forced continuously into the area of the channels 14 and 15 owing to the constant rotation thereof. As a result thereof, the combustion air of relatively low temperature supplied by the compressor of the gas turbine can flow through the channel 14 into the heated-up through-channels 18 and can absorb heat during such passage. The thus heated combustion air is fed through the channel 15 to the combustion chamber of the gas turbine. Simultaneously therewith, the exhaust gases cooled off in the remaining section of the storage body 13 leave the housing 12 of the heat-exchanger through the channel 17. The direction of flow of the combustion air and of the exhaust gases is indicated in FIG. 1 by arrows.

The channels 15 to 17 include within the area of the storage body 13 an approximately semi-circularly shaped cross-sectional area which permits a maximum loading of the storage body 13. Sealing elements generally designated by reference numeral 26 and constructed corresponding to the channel cross section are arranged at the end faces 24 of the walls 25 of the housing 12 delimiting the channels, which sealing elements prevent an escape of the exhaust gases or of the combustion air at the respective contact places with the storage body 13. No seal is necessary at the end of the channel 14 since the supplied combustion air can follow only the path through the storage body 13 into the channel 15 inside of the housing 12 by reason of the sealing elements 26 of the remaining channels 15, 16 and 17.

The sealing elements 26 consist of a sealing bar 27, which abuts with a slide layer 28 at the sealing body 13, and of an elastic sealing diaphragm 29 which has a U-shaped configuration in cross section and which extends over the gap between the sealing bar 27 and the oppositely disposed end face 24 of the wall 25 of the housing 12.

Figure 2:
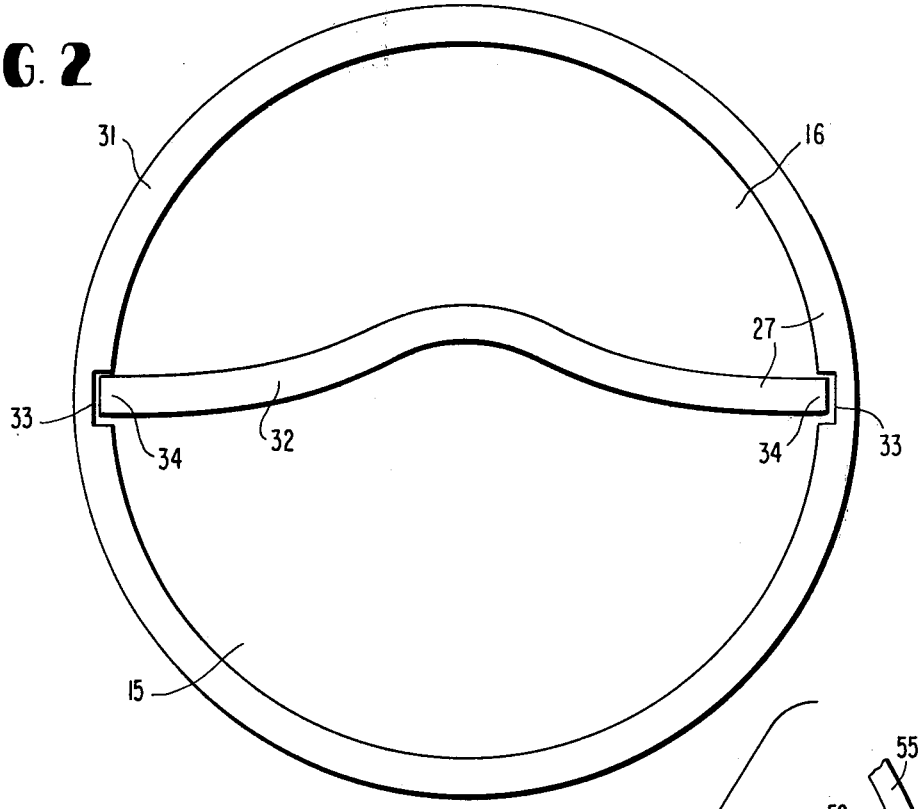
FIG. 2 is a plan view on the sealing bar of the sealing arrangement in accordance with the present invention, which delimits the gas inlet channel and the air discharge channel.

The sealing bar 27 abutting at the one end face 30 of the storage body 13, which together with the sealing diaphragm 29 seals off the channel 16 for the gas inlet and the channel 15 for the air outlet is composed, as shown in FIG. 2, of a ring-shaped partial member 31 and of a web-like partial member 32 which separates from one another the channels 15 and 16. The ring-shaped partial member 31 includes two mutually oppositely disposed rectangular recesses 33 (FIG. 2) which serve for the accommodation of the ends 34 of the web-like partial member 32. Since the web-like partial member 32 is more strongly heated-up during the operation of the heat-exchanger than the ring-shaped partial member 31 and thereby correspondingly expands more strongly, the web-like partial member 32 is inserted into the recesses 33 of the ring-shaped partial member 31 with an axial and with a slight lateral play.

Figure 3:
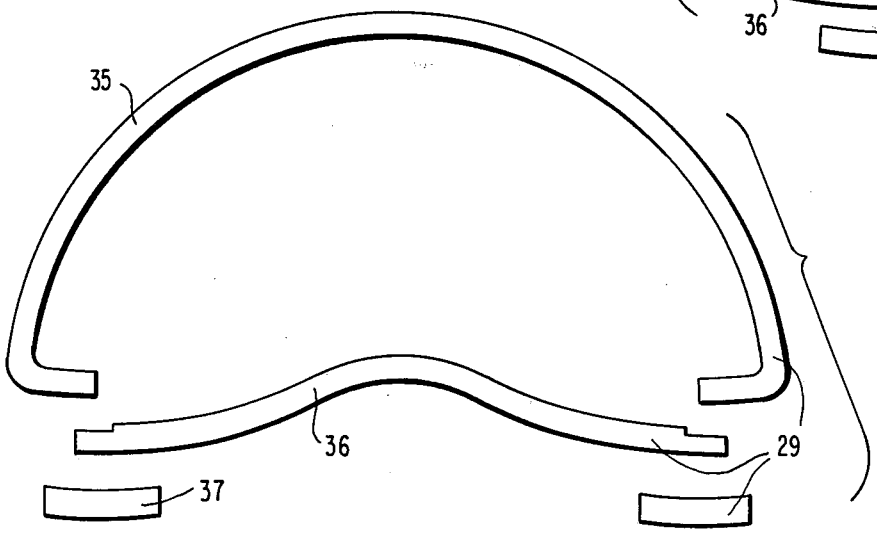
FIG. 3 is a plan view on the parts of the sealing diaphragm of the sealing arrangement in accordance with the present invention, which delimits the gas inlet channel.

The sealing diaphragm 29 shown in FIG. 3 for the channel 16 serving the gas inlet is also subdivided into individual structural parts which correspond to the partial members 31 and 32 of the sealing bar 27. In addition to a semi-ring-shaped partial member 35 and to a web-like partial member 36, the sealing diaphragm 29 additionally includes two cover members 37.

Figure 5:
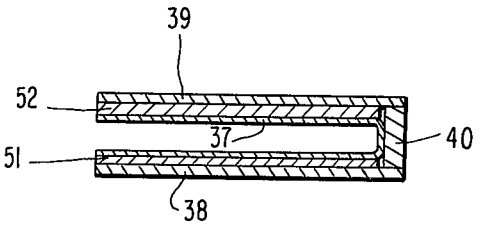
FIG. 5 is a cross-sectional view through the sealing diaphragm of the seal in accordance with the present invention, taken along line V—V of FIG. 4.
Figure 4:
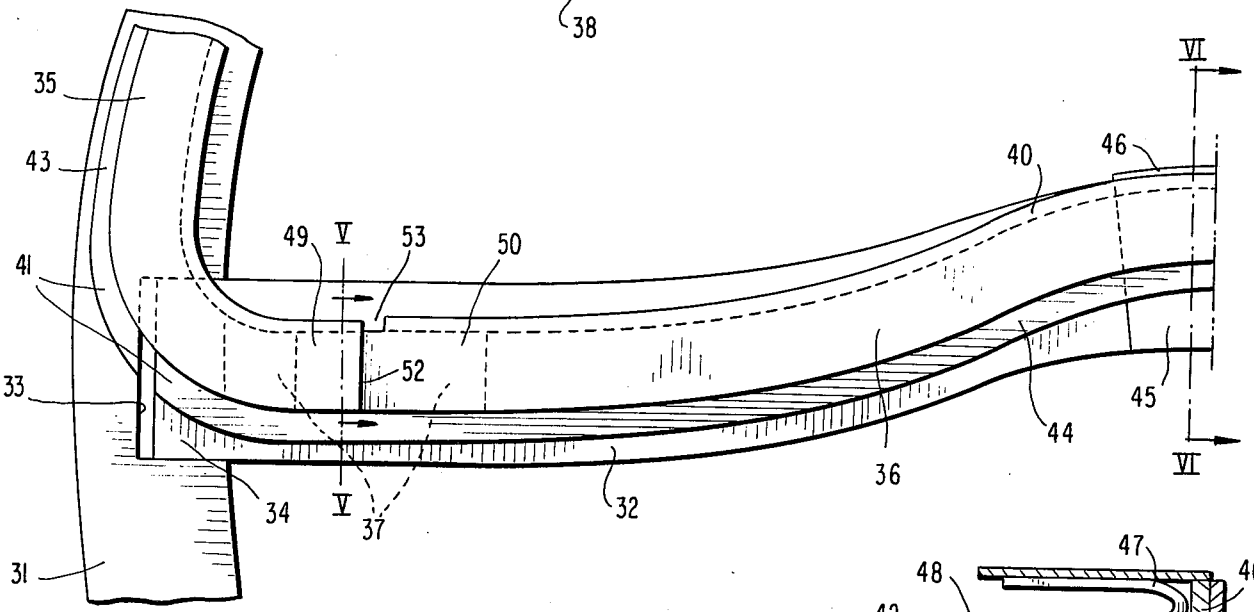
FIG. 4 is a partial plan view on the assembled seal in accordance with the present invention within the area of a connecting place between a web-like partial member and a ring-shaped partial member.
Figure 6:
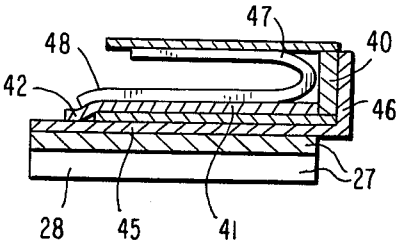
FIG. 6 is a cross-sectional view through the seal in accordance with the present invention, taken along line VI—VI of FIG. 4.
Figure 7:
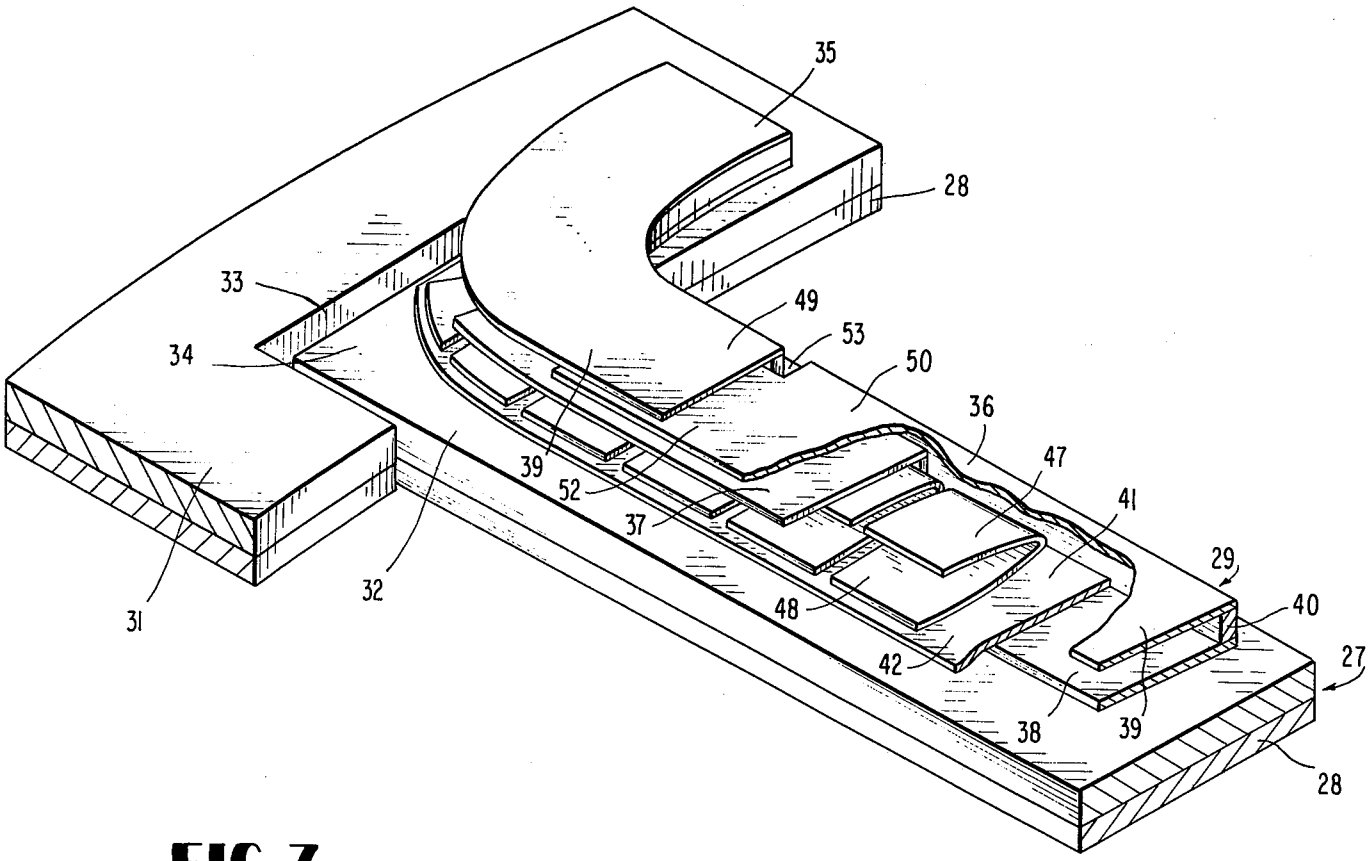
FIG. 7 is a partial perspective view of a connecting place of a seal according to the present invention.

FIGS. 4 to 7 illustrate the construction of the seal as well as the configuration and effect of its individual parts. The partial members 35 and 36 (FIGS. 3 and 7) of the sealing diaphragm 29 consist each of two legs 38 and 39 which are connected with each other by a web 40 (FIGS. 5 and 7). They have in each case the same U-shaped cross-sectional area. The sealing diaphragm 29 is enclosed at its one leg 38 and pressed against the sealing bar 27 by an elastic clamping strip 41 (FIGS. 4, 6, and 7). The clamping strip 41 extends strip-shaped along the sealing bar 27 and is secured along its one edge 42 at the sealing bar 27. Corresponding to the subdivision of the sealing diaphragm 29 into partial members 35 and 36, also the clamping strip 41 is subdivided into partial members 43 and 44 (FIG. 4).

In the center of the web-like partial member 32 of the sealing bar 27, a sheet-metal angle member 45 (FIGS. 4 and 6) is secured on the web-like partial member 32, whereby the projecting leg of the angle member 45 is disposed opposite the web 40 of the sealing diaphragm 29 and serves as abutment 46 (FIG. 6) for the same. The partial member 44 of the elastic clamping strip 41 in cooperation with the abutment 46 retains the partial member 36 of the sealing diaphragm 29 in the correct position relative to the partial member 32 of the sealing bar 27 and as a result of its yieldingness enables different thermal expansions both in the sealing diaphragm 29 as also with respect to the sealing bar 27. One or several similar abutments for the partial member 35 of the sealing diaphragm 29 may be arranged analogously on the partial member 31 of the sealing bar 27.

V-shaped bent leaf spring elements 47 (FIGS. 6 and 7) are arranged inside the sealing diaphragm 29, which expand the legs 38 and 39 of the sealing diaphragm 29 and therewith assist the tight abutment thereof at the oppositely disposed end face 24 of the wall 25 of the housing 12. The leaf spring elements 47 are secured with their one edge 48 at the clamping strip 41.

The semi-ring-shaped partial member 35 of the sealing diaphragm 29 is constructed and secured at the ring-shaped partial member 31 of the sealing bar 27 in the same manner as the web-like partial member 36. Within the area of each of the two connecting places between the ring-shaped partial member 31 and the web-like partial member 32 of the sealing bar 27, the end 49 (FIGS. 4 and 7) of the semi-ring-shaped partial member 35 is curved inwardly in the direction toward the end 50 of the web-like partial member 36 of the sealing diaphragm 29. The web-like partial member 36 of the sealing diaphragm 29 terminates within this area at its end 50 into two free legs 51 and 52 (FIGS. 4, 5 and 7) not connected with each other by a web, which are enclosed and guided by the legs 38 and 39, connected with each other by the web 40, of the end 49 of the semi-ring-shaped partial member 35 of the sealing diaphragm 29. The thin-walled cover member 37 (FIGS. 4, 5 and 7) of the sealing diaphragm 29 which is U-shaped in cross section, is arranged inside of the overlapping ends 49 and 50 of the partial members 35 and 36 of the sealing diaphragm 29; the cover member 37 thereby bridges the connecting place of the partial members 35 and 36. In particular, the gap 53 (FIGS. 4 and 7) at the free legs 51 and 52 which changes depending on the occurring thermal expansions, is sealed off within the area between the ends of the webs 40 of the semi-ring-shaped and of the web-shaped partial members 35 and 36 of the sealing diaphragm 29. The cover member 37 as also the overlapping ends 49 and 50 of the partial members 35 and 36 of the sealing diaphragm 29 are retained by the partial member 44 of the clamping strip 41.

Figure 8:
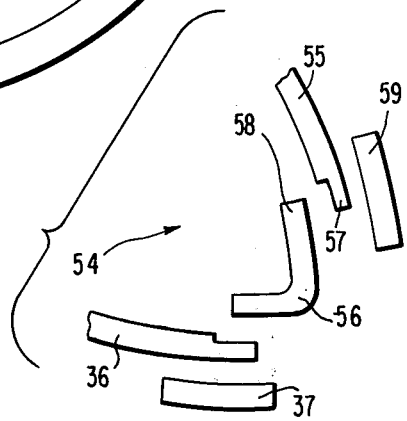
FIG. 8 is a partial exploded plan view on the parts of a further sealing diaphragm in accordance with the present invention delimiting the gas inlet channel.

FIG. 8 illustrates individual structural parts of a further sealing diaphragm for the channel 16 serving the gas inlet within the area of a connecting place between the ring-shaped partial member 31 and the web-like partial member 32 of the sealing bar 27. Differing from the preceding embodiment, the semi-ring-shaped partial member generally designated by reference numeral 54 of the sealing diaphragm of FIG. 8 is further subdivided into the partial members 55 and 56. The end of the partial member 55 terminates in free legs 57 which, with an assembled sealing diaphragm, are enclosed and guided by the end 58 of the partial member 56. As in the preceding embodiment, a cover member 59 for covering a gap is inserted inside of the partial members 55 and 56 within the area of overlap thereof. The partial members 55 and 56 as well as the cover member 59 are retained in the installed condition by a partial member of a clamping strip.

In lieu of rectangular webs between the legs of the sealing diaphragm, also tubularly shaped webs may be arranged thereat. In lieu of the sealing diaphragms U-shaped in cross section, also those with V-shaped cross-sectional area may be used. The individual parts of the seal may be connected with each other by brazing or welding, especially by spot-welding.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A seal for gas channels of a regenerative heat-exchanger, comprising sealing bar means operable to abut at a rotatable disk-shaped storage body means, and sealing diaphragm means which assisted by leaf spring means extends over the gap between the sealing bar means and an oppositely disposed housing wall, characterized in that the sealing diaphragm means includes leg portions, one of said leg portions being enclosed and pressed against the sealing bar means by a clamping strip means secured near its edge along the sealing bar means, said sealing diaphragm means having a back portion disposed opposite at least one abutment means arranged at the sealing bar means.

2. A seal according to claim 1, characterized in that said sealing diaphragm means is U-shaped in cross section.

3. A seal according to claim 1, characterized in that said sealing diaphragm means is V-shaped in cross section.

4. A seal according to claim 1, characterized in that the sealing diaphragm means retained by the clamping strip means is composed of partial members, of which at the connecting places of two partial members, the end of one partial member terminates in two free leg portions not directly connected with each other, which are so enclosed by the end of the other partial member that the leg portions thereof for the most part overlap the free leg portions of the first-mentioned partial member.

5. A seal according to claim 4, characterized in that the clamping strip means which is undivided at least at the connecting place of two partial members encloses respectively two overlapping leg portions of the two partial members of the sealing diaphragm means.

6. A seal according to claim 5, characterized in that a cover means is arranged within the area of the overlapping ends of the partial members of the sealing diaphragm means and inside thereof, said cover means having leg portions, one of the leg portions of the cover means being also enclosed by the clamping strip means.

7. A seal according to claim 6, characterized in that said cover means is substantially U-shaped in cross section.

8. A seal according to claim 6, characterized in that said cover means is substantially V-shaped in cross section.

9. A seal according to claim 6, with a sealing bar means which includes a ring-shaped partial member and a web-like partial member which with its two ends is inserted with clearance into two mutually oppositely disposed recesses provided in the ring-shaped partial member and which separates from one another the gas inlet channel and the air discharge channel, characterized in that within the area of each connecting place between the ring-shaped partial member and the web-like partial member of the sealing bar means, the partial member of the sealing diaphragm means which is retained on the web-like partial member by a partial member of the clamping strip means, terminates in free leg portions which are enclosed by an inwardly curved end of the partial member of the sealing diaphragm means which is retained on the ring-shaped partial member of the sealing bar means by a partial member of the clamping strip means.

10. A seal according to claim 1, with a sealing bar means which includes a ring-shaped partial member and a web-like partial member which with its two ends is inserted with clearance into two mutually oppositely disposed recesses provided in the ring-shaped partial member and which separates from one another the gas inlet channel and the air discharge channel, characterized in that within the area of each connecting place between the ring-shaped partial member and the web-like partial member of the sealing bar means, a partial member of the sealing diaphragm means which is retained on the web-like partial member by a partial member of the clamping strip means, terminates in free leg portions which are enclosed by an inwardly curved end of a partial member of the sealing diaphragm means which is retained on the ring-shaped partial member of the sealing bar means by a partial member of the clamping strip means.

* * * * *